US011578288B2

(12) United States Patent
Cattoz et al.

(10) Patent No.: US 11,578,288 B2
(45) Date of Patent: Feb. 14, 2023

(54) OIL COMPOSITIONS

(71) Applicant: Infineum International Limited, Abingdon (GB)

(72) Inventors: Beatrice N. Cattoz, Bristol (GB); Peter M. Wright, Faringdon (GB); Andrew Dove, Barnt Green (GB); Rachel O'Reilly, Barnt Green (GB); Cinzia Clamor, Birmingham (GB)

(73) Assignee: INFINEUM INTERNATIONAL LIMITED, Abingdon (GB)

( * ) Notice: Subject to any disclaimer, the term of this patent is extended or adjusted under 35 U.S.C. 154(b) by 0 days.

(21) Appl. No.: 17/347,686

(22) Filed: Jun. 15, 2021

(65) Prior Publication Data

US 2021/0388284 A1 Dec. 16, 2021

(30) Foreign Application Priority Data

Jun. 16, 2020 (EP) ..... 20180354

(51) Int. Cl.

| | |
|---|---|
| ***C10M 145/22*** | (2006.01) |
| ***C10M 151/04*** | (2006.01) |
| ***C10M 169/04*** | (2006.01) |
| *C10N 40/25* | (2006.01) |
| *C10N 40/04* | (2006.01) |

(52) U.S. Cl.

CPC ..... *C10M 145/22* (2013.01); *C10M 151/04* (2013.01); *C10M 169/041* (2013.01); *C10M 2209/102* (2013.01); *C10M 2221/041* (2013.01); *C10N 2040/04* (2013.01); *C10N 2040/252* (2020.05); *C10N 2040/255* (2020.05)

(58) Field of Classification Search

CPC ..... C10M 145/22; C10M 2203/1025; C10M 2207/289; C10M 2209/102; C10N 2020/02; C10N 2020/04; C10N 2030/06; C10N 2040/252; C10N 2040/255; C10N 2070/00

See application file for complete search history.

(56) References Cited

U.S. PATENT DOCUMENTS

| | | | | |
|---|---|---|---|---|
| 4,362,635 | A * | 12/1982 | Dhein | C10M 133/12 508/222 |
| 4,715,973 | A | 12/1987 | de Jong et al. | |
| 2014/0179572 | A1 | 6/2014 | Loper et al. | |
| 2020/0231760 | A1* | 7/2020 | Becker | C08G 63/91 |

FOREIGN PATENT DOCUMENTS

| | | | |
|---|---|---|---|
| EP | 2213694 | B1 | 7/2013 |
| GB | 1330525 | A | 9/1973 |
| WO | 2013-154978 | A1 | 10/2013 |

OTHER PUBLICATIONS

Maria T. Hernandez-Sierra et al., Effect of Poly(e-Caprolactone) as a Bio-Lubricant Additive in AISI 4140 Steel/ Al2O3 Tribosytem. MRS Advances, 2019 Materials Research Society, Jan. 1, 2019, vol. 4, No. 57-58, pp. 3105-3112, XP055746744.

* cited by examiner

*Primary Examiner* — Vishal V Vasisth

(74) *Attorney, Agent, or Firm* — Loza & Loza, LLP; Robert Goozner

(57) ABSTRACT

An oil composition comprises at least 50 percent by mass, based on the mass of the composition, of an oil and 0.01 to 25 percent by mass, based on the mass of the composition, of a polymer comprising at least one poly(lactone) segment. The at least one poly(lactone) segment is derived from a lactone substituted by one or two hydrocarbyl groups, or substituted hydrocarbyl groups, at least one such group having at least 4 carbon atoms. The oil compositions are suitable for use in the lubrication of the crankcase of internal combustion engines.

23 Claims, No Drawings

OIL COMPOSITIONS

FIELD OF THE INVENTION

This invention relates to oil compositions containing polymeric additives. In particular, to lubricating oil compositions useful for example, to lubricate the crankcase of spark-ignited or compression-ignited internal combustion engines. More especially, the additives are polymers containing at least one segment which is derived from a substituted lactone. The polymers provide friction modifying properties to lubricating oils and also have excellent solubility in base oils.

BACKGROUND OF THE INVENTION

There is much interest in improving the fuel economy of gasoline and diesel engines. This can be done, through the engine lubricating oil, by reducing the friction contribution either of the bulk fluid (by lowering the oil viscosity) or improving the friction of the contacting parts by inclusion of friction modifier additives. Oil compositions used for purposes other than engine lubrication may also benefit from reduced friction.

There is therefore interest in additives which provide oils with low friction properties.

It is also important that additives used in oils have good solubility, in order for the oils to remain stable under prolonged storage.

Polymers derived from lactone monomers, poly(lactones), are known in the art. Numerous studies Poly(lactones) have found use in the formation of various coatings plastics, and fibres. Many lactones and poly(lactones) are biocompatible and a range can be made from naturally occurring compounds. Accordingly, poly(lactones) have been disclosed for medical applications. For example, WO20181142384 A2 describes how co-polymers formed from lactone and poly(propylene fumarate) can be used as feeds in additive manufacturing (3D printing) to produce medical devices and structures for in-vivo application. Poly (lactones) are commonly formed via ring-opening polymerisation (ROP).

The present invention is based on polymers which contain at least one polymeric segment which is derived from a lactone substituted by a group of a certain minimum carbon chain length. It has been found that the presence of this polymeric segment provides the polymers with beneficial properties when used as additives in oil compositions. In the polymer art, crystallisation driven self-assembly (CDSA) has become a powerful tool for the preparation of nanostructures with well-defined dimensions. Polymers having a solvophobic core block can undergo CDSA to yield various nanostructures, driven by the crystallisation behaviour of the core polymer block. These can take the form of spherical micelles, wormlike cylinders, rods, and platelets of various morphologies. Owing to their backbone and hydrophobic properties, poly(lactones) are good candidates for CDSA and it is presently theorized that the various nanostructures obtainable via CDSA contribute to the effectiveness of the polymers as additives when used in oil compositions, including lubricating oil compositions.

SUMMARY OF THE INVENTION

The invention relates to oil compositions comprising at least 50 percent by mass, based on the mass of the composition of an oil and 0.01 to 25 percent by mass, based on the mass of the composition, of a polymer comprising at least one poly(lactone) segment; wherein the at least one poly (lactone) segment is derived from a lactone substituted by one, two or three, preferably one or two hydrocarbyl groups, or substituted hydrocarbyl groups, at least one such group having at least 4 carbon atoms.

Preferably, at least one hydrocarbyl group, or substituted hydrocarbyl group substituent of the lactone has 4 to 24 carbon atoms, more preferably 6 to 20 carbon atoms, even more preferably 6 to 18 carbon atoms, for example, 8 to 18 carbon atoms.

Preferably, the oil composition is a lubricating oil composition, more preferably a lubricating oil composition formulated for the lubrication of the crankcase of a spark-ignited or a compression-ignited internal combustion engine. In a preferred embodiment, the lubricating oil composition, in addition to the polymer, further comprises one or more performance-enhancing co-additives, as described hereinbelow.

The polymer may be a homo-polymer derived from a single type of lactone, in which case, that lactone is substituted by one, two or three, preferably one or two hydrocarbyl groups, or substituted hydrocarbyl groups, at least one such group having at least 4 carbon atoms. Alternatively, the polymer may be a co-polymer comprising two or more different poly(lactone) segments. In this embodiment, at least one segment must be derived from a lactone substituted by one, two or three, preferably one or two hydrocarbyl groups, or substituted hydrocarbyl groups, at least one such group having at least 4 carbon atoms. Other poly(lactone) segments present in a co-polymer may be derived from unsubstituted lactones or from lactones substituted by one, two or three, preferably one or two hydrocarbyl groups, or substituted hydrocarbyl groups.

In preferred embodiments, the polymers are derived from ε-caprolactones. As above, when the polymer is a homo-polymer, the ε-caprolactone is substituted by one, two or three, preferably one or two hydrocarbyl groups, or substituted hydrocarbyl groups, at least one such group having at least 4 carbon atoms. Similarly, when a co-polymer, at least one segment is derived from an ε-caprolactone substituted by one, two or three, preferably one or two hydrocarbyl groups, or substituted hydrocarbyl groups, at least one such group having at least 4 carbon atoms. Other segments may be derived from unsubstituted ε-caprolactone or from ε-caprolactone substituted by one, two or three, preferably one or two hydrocarbyl groups, or substituted hydrocarbyl groups.

Co-polymers may be of different types. As examples of co-polymers there may be mentioned statistical co-polymers which are formed where the polymerisation follows a known statistical rule, for example Bernouillian statistics or Markovian statistics. A statistical co-polymer where the probability of finding a particular type of monomer residue at any particular point in the polymer chain is independent of the types of surrounding monomers can be referred to as a random copolymer. Statistical and random co-polymers may be distinguished from more ordered co-polymer types such as alternating co-polymers, periodic co-polymers, gradient co-polymers and block co-polymers.

In a preferred embodiment of the present invention, the polymer is a block co-polymer, i.e. where two or more polymer sub-units are linked by covalent bonds (e.g. as di- or tri-blocks). The blocks in a block co-polymer may be of equal size or of different sizes and the architecture of the co-polymers can vary. For example, block co-polymers may have only a single block of each monomer (i.e. in a 'AB' arrangement) or multiple blocks of each monomer (i.e. in an 'ABABAB . . . ' arrangement) where blocks 'A' and 'B' may be the same size or of different sizes.

Accordingly, in a first aspect, the present invention provides an oil composition comprising at least 50 percent by mass, based on the mass of the composition of an oil and 0.01 to 25 percent by mass, based on the mass of the composition, of a polymer comprising at least one poly (lactone) segment; wherein the polymer comprises units (a):

$$—C(O)(CHR^1)_pO— \quad (a)$$

wherein p is an integer from 4 to 7; wherein in one, two or three, preferably one or two instances p, $R^1$ is a hydrocarbyl group or substituted hydrocarbyl group having from 4 to 24 carbon atoms, and in all other instances p, $R^1$ is hydrogen; and optionally, units (b):

$$—C(O)(C(H)_xR^2)_qO— \quad (b)$$

wherein units (b) are different from units (a); wherein q is an integer from 4 to 15; and wherein either (i), in all instances q, $R^2$ is hydrogen, or (ii), wherein in one, two or three, preferably one or two instances q, $R^2$ is a hydrocarbyl group or substituted hydrocarbyl group having from 1 to 24 carbon atoms, and in all other instances q, $R^2$ is hydrogen; and wherein either in all instances q, x is 1, or for two contiguous moieties q, x is zero such that units (b) comprise one carbon-carbon double bond, and in all other instances q, x is 1.

In a second aspect, the invention provides a method of lubricating the crankcase of an internal combustion engine comprising operating the engine and lubricating the crankcase with an oil composition of the first aspect of the invention in the form of a lubricating oil composition.

In a third aspect, the present invention provides the use of a polymer as defined in relation to the first aspect as an additive in an oil composition, to reduce friction between contacting surfaces lubricated by the composition. Preferably in this third aspect, the oil composition is a lubricating oil composition and the polymer is used as an additive in the lubricating oil composition to reduce friction in an internal combustion engine lubricated by the composition. More preferably, in this third embodiment, the polymer is used in combination with one or more performance-enhancing co-additives, as described hereinbelow.

DETAILED DESCRIPTION OF THE INVENTION

Definitions

In this specification, the following words and expressions, if and when used, have the meaning given below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or any cognate word. The expression "consists essentially of" permits inclusion of substances not materially affecting the characteristics of the composition to which it applies. The expression "consists of" or cognates means only the stated features, steps, integers components or groups thereof are present to which the expression refers;

"hydrocarbyl" means a chemical group of a compound that contains hydrogen and carbon atoms and that is bonded to the remainder of the compound directly via a carbon atom. The use of the qualifier "substituted" means that the hydrocarbyl group may contain one or more atoms other than carbon and hydrogen ("hetero atoms"). Those skilled in the art will be aware of suitable groups (e.g., halo, especially chloro and fluoro, amino, alkoxyl, carboxy, ester, mercapto, alkylmercapto, nitro, nitroso, sulfoxy, etc.). The group may be unsaturated, and/or may be polymeric;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"ashless" in relation to an additive means the additive does not include a metal;

"ash-containing" in relation to an additive means the additive includes a metal;

"major amount" means in excess of 50 mass % of a composition or mixture;

"minor amount" means 50 mass % or less of a composition or mixture;

"effective amount" in respect of an additive means an amount of such an additive in the composition (e.g. an additive concentrate) that is effective to provide, and provides, the desired technical effect;

"ppm" means parts per million by mass, based on the total mass of the composition;

"metal content" of a composition or of an additive component, for example molybdenum content or total metal content of the additive concentrate (i.e. the sum of all individual metal contents), is measured by ASTM D5185;

"TBN" in relation to an additive component or of a composition, means total base number (mg KOHg) as measured by ASTM D2896;

"$KV_{100}$" means kinematic viscosity at 100° C. as measured by ASTM D445;

HTHS means High Temperature High Shear at 150° C. as measured by—CEC-L-36-A-90.

"phosphorus content" is measured by ASTM D5185;

"sulfur content" is measured by ASTM D2622;

"sulfated ash content" is measured by ASTM D874;

$M_n$ means number average molecular weight as measured by Gel Permeation Chromatography with reference to linear narrow polystyrene standards in the range of 550 to 600,000 g/mol;

$M_w$ means weight average molecular weight as measured by Gel Permeation Chromatography with reference to linear narrow polystyrene standards in the range of 550 to 600,000 g/mol;

"dispersity" means $M_w/M_n$, (denoted by Đ)

Also, it will be understood that various components used, essential as well as optimal and customary, may react under condition of formulation, storage and use and that the invention also provides the product(s) obtainable or obtained by any such reaction.

Further it is understood that any upper and lower quality, range or ratio limits set forth herein may be independently combined.

Polymers

The oil compositions of the present invention contain a polymer comprising at least one poly(lactone) segment as described above. These are suitably obtained through the ring-opening polymerisation of lactones and/or substituted lactones, as described in more detail hereinbelow. All polymers described are applicable to all aspects of the present invention.

The polymer comprises units (a):

$$—C(O)(CHR^1)_pO— \quad (a)$$

wherein p is an integer from 4 to 7; wherein in one, two or three, preferably one or two instances p, $R^1$ is a hydrocarbyl group or substituted hydrocarbyl group having from 4 to 24 carbon atoms, and in all other instances p, $R^1$ is hydrogen; and optionally, units (b):

$$—C(O)(C(H)_xR^2)_qO— \quad (b)$$

wherein units (b) are different from units (a); wherein q is an integer from 4 to 15; and wherein either (i), in all instances q, $R^2$ is hydrogen, or (ii), wherein in one, two or three, preferably one or two instances q, $R^2$ is a hydrocarbyl group or substituted hydrocarbyl group having from 1 to 24 carbon atoms, and in all other instances q, $R^2$ is hydrogen; and wherein either in all instances q, x is 1, or for two contiguous moieties q, x is zero such that units (b) comprise one carbon-carbon double bond, and in all other instances q, x is 1.

Preferably, the polymer carries an inorganic or organic polymerisation terminating group (t), and an initiator group (i) being effective to initiate the ring-opening polymerisation of lactones.

The terminating group (t) is not critical and suitable terminating groups (t) will be known to those skilled in the art. Some non-limiting examples are described by Mahamad Takwa et al., in Macromol. Rapid Comms, 2006, 27, 1932-1936. Preferably, the terminating group (t) is hydrogen, derived by quenching the polymerisation reaction with a quenching agent. As known in the art, any protic species may be used as a quenching agent. Examples include water, alcohols, phenols or acidic species such as benzoic acid, trifluoroacetic acid or any other suitable acid.

The initiator group (i) is not critical and suitable initiator groups (i) will be known to those skilled in the art. Preferably, the initiator group (i) is $OR^6$, $SR^6$, $NHR^6$ or $NR^6R^7$ where $R^6$ and $R^7$ are independently hydrogen, hydrocarbyl groups or substituted hydrocarbyl groups, which may be aliphatic, cyclic or polycyclic, aromatic or polyaromatic. Non-limiting examples can be found for example in "*Phosphazene-catalysed ring-opening polymerisation of ε-caprolactone: influence of solvents and initiators*", Haleema Alamri et al., Polym. Chem. 2.4, 5, 5471. A specific example, used in the syntheses described hereinbelow, is where the initiator group (i) is $OR^6$, where $R^6$ is the 4-methoxybenzyl group. Polymerisation may also be initiated by a polymer, in which case the initiator group (i) is a residue of that polymer. As described in more detail below, in the production co-polymers, a homo-polymer carrying a hydroxy group can be used to initiate the polymerisation of second monomer.

Value p results from the size of the lactone used in the preparation of the polymers. Preferred lactones are substituted caprolactones, polymerisation of which results in units (a) where p is 5 and so preferably, p is 5.

In an embodiment, the polymer comprises units (a) only. The moiety $(CHR^1)_p$ in polymer units (a) represents a chain of p $CHR^1$ moieties. For example, where p=5, the moiety $(CHR^1)_p$ can be written $—CHR^1—CHR^1—CHR^1—CHR^1—CHR^1—$. In units (a), in one, two or three, preferably one or two instances p, $R^1$ is a hydrocarbyl group or substituted hydrocarbyl group having from 4 to 24 carbon atoms. In all other instances p, $R^1$ is hydrogen. However, within these constraints, the position of the substituent(s) $R^1$ which is/are not hydrogen is not fixed. As described in more detail below, the position of substituent(s) $R^1$ which is/are not hydrogen is determined by the structure of the lactone monomer used to form the polymer. So, again, in the case where p=5, and where only one $R^1$ is hydrocarbyl (indicated below by 'hyd'), the following arrangements are possible for the moiety $(CHR^1)_p$:

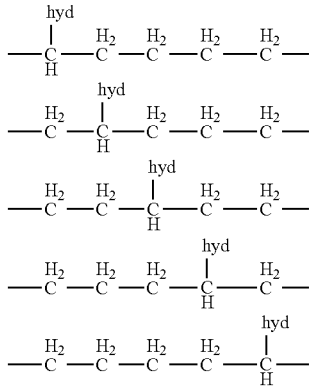

It will be understood that some arrangements are more synthetically challenging than others and that some, for example the first arrangement above, may polymerize more slowly than others. It will also be understood how analogous arrangements are possible for other values p and also for embodiments where R, is not hydrogen in two or more instances p.

In an embodiment, the polymer also comprises units (b). The moiety $(C(H)_xR^2)_q$ in units (b) may be such that in all instances q, $R^2$ is hydrogen. Value x may be 1 in all instances q and so the moiety $(C(H)_xR^2)_q$ may exist in the same arrangements as described above in relation to units (a). Alternatively, for two contiguous moieties q, x is zero such that units (b) comprise one carbon-carbon double bond, and in all other instances q, x is 1. An illustrative example of a unit (b) containing one carbon-carbon double bond is:

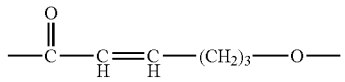

where q is 5, $R^2$ is hydrogen in all instances q, in two contiguous moieties q, x is zero to provide the carbon-carbon double bond, and in the other three instances q, x is 1. It will be understood that the carbon-carbon double bond may be in any position along the carbon chain. Analogous structures where not all groups $R^2$ are hydrogen will similarly be understood. Units (b) containing a carbon-carbon double bond may be obtained by polymerising unsaturated lactones.

In a preferred embodiment, in units (a), $R^1$ is not hydrogen in one or two instances p, more preferably in only one instance p.

In one preferred embodiment where units (b) are present, $R^2$ is hydrogen in all instances q. In another preferred embodiment where units (b) are present, $R^2$ is not hydrogen in one or two instances q, more preferably in only one instance q.

As described above, values p and q result from the size of the lactones used in the preparation of the polymers. Preferably, p is 5 and preferably q is an integer from 4 to 10, more preferably from 4 to 7. Preferred lactones are caprolactone and hydrocarbyl-substituted caprolactones. Polymerisation of caprolactone and hydrocarbyl-substituted caprolactones results in units (a) and (b) where p and q are 5 and so preferably at least p or q is 5 and more preferably, p and q are both 5.

$R^1$, when not hydrogen, is a hydrocarbyl group or substituted hydrocarbyl group having from 4 to 24 carbon atoms. Preferred hydrocarbyl groups or substituted hydrocarbyl groups are those having 6 to 20 carbon atoms, more preferably 6 to 18 carbon atoms, even more preferably, 8 to 18 carbon atoms. Hydrocarbyl groups may be saturated or unsaturated, linear or branched, alicyclic or aromatic. Preferred are linear or branched alkyl and alkenyl groups.

Particularly preferred as $R^1$, when it is not hydrogen, are linear $C_8$, $C_{10}$, $C_{12}$, $C_{14}$, $C_{16}$ or $C_{18}$ alkyl groups, particularly a $C_{12}$ alkyl group.

Preferred alkenyl groups are those which are terminally unsaturated. Terminal unsaturation permits further functionalisation.

Substituted hydrocarbyl groups include those which carry one or more hetero atoms, functional groups or those which have been modified by reaction with other moieties. Particular examples include thioether groups of the structure —$R^3SR^4$ where $R^3$ is an alkyl moiety having 1 to 10 carbon atoms, and where $R^4$ may be chosen from the same type of hydrocarbyl groups described hereinabove for $R^1$ and $R^2$.

Groups $R^2$, when not hydrogen, are preferably as defined in relation to $R^1$ however also suitable are analogues of $R^1$ which have fewer than 4 carbon atoms. So for example, in addition to those groups defined in relation to $R^1$, groups $R^2$ may be methyl, ethyl, propyl, and similar.

The polymers used in the present invention may comprise any suitable number of units (a), and where present, units (b). Preferably, the total number of units (a) and (b) in the polymer is from 10 to 1000, preferably 25 to 400.

When units (b) are present, the ratio of the number of units (a) to the number of units (b) in the polymer may be any suitable value however preferably, the ratio of the number of units (a) to the number of unit (b) is from 1:200 to 200:1, more preferably from 1:100 to 100:1, or from 1:50 to 50:1, or from 1:25 to 25:1, or from 1:10 to 10:1, or from 1:5 to 5:1, for example 1:1.

When units (b) are present, preferably the polymer is a block-copolymer.

In a preferred embodiment, the polymer consists of units (a) and units (b) only (excepting the terminating group (t), and initiator group (i) when present). Block co-polymers consisting of units (a) and units (b) only may have an architecture where there is a single block of units (a) and a single block of units (b) but other architectures are possible. For example, block co-polymers may have a single block of units (a) or (b) surrounded by units of the other type in an 'ABA' or 'BAB' arrangement. Other architectures will be apparent to the skilled person, for example 'ABAB', 'ABAB . . . ', and similar.

In other embodiments where units (a) and (b) are present, further structural units may be present in the polymer. For example, the polymer may further comprise units (c):

$$—C(O)(C(H)_xR^5)_rO— \quad (c)$$

wherein units (c) are different from units (a) and (b); wherein r is an integer from 4 to 15; wherein either (i) in all instances r, $R^1$ is hydrogen, or (ii) wherein in one, two or three, preferably one or two instances r, $R^5$ is a hydrocarbyl group or substituted hydrocarbyl group having from 1 to 24 carbon atoms, and in all other instances r, $R^5$ is hydrogen; and wherein either in all instances r, x is 1, or for two contiguous moieties r, x is zero such that units (c) comprise one carbon-carbon double bond, and in all other instances r, x is 1.

Preferably, values r and $R^5$ are as defined in relation to values q and $R^2$ in units (b). Preferably, r is 5.

Polymers containing units (c) are terpolymers, being comprised of three different structural units. As described above, block co-polymers of various architectures are possible. Examples include those where single blocks of units (a), (b) and (c) are present, e.g. in an 'ABC' or similar arrangement, or where multiple blocks of one of more of units (a), (b) or (c) are present such as in a 'ABCA' and similar arrangements.

Those skilled in the art will appreciate that higher polymers may also be produced. Such polymers would include further units of the same type as, but different from, units (b) and (c).

Preferably, the polymer has a number average molecular weight (Mn) of 2,000-500,000 g/mol. More preferably, the polymer has a number average molecular weight (Mn) of 5,000-400,000 g/mol. Even more preferably, the polymer has a number average molecular weight (Mn) of 8,000-400,000 g/mol, for example 8,000-200,000 g/mol. All molecular weights are as measured by Gel Permeation Chromatography with reference to linear narrow polystyrene standards in the range of 550 to 600,000 g/mol.

The polymers used in the lubricating oil compositions of the present invention are preferably made via the ring-opening polymerisation of lactones and/or substituted lactones. Such reactions are well known in the art.

A polymer consisting of units (a) only can be formed by the ring-opening polymerisation of a lactone of the structure:

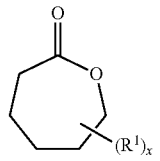

The illustrative example above is based on a caprolactone structure (7-membered ring) but of course, lactones of larger and smaller sizes can be used. Substituent(s) $R^1$, as defined with reference to units of structure (a), may be attached at to any carbon atom on the lactone ring. The position of group(s) $R^1$ on the lactone ring determines the position of the same groups in units (a). There may be one substituent $R^1$ (where x=1), or two substituents $R^1$ (where x=2).

The ring-opening polymerisation of lactones is facile and as is known in the art, can be catalysed by a Lewis acid organometallic or organic catalyst using a nucleophilic initiator. Suitable catalysts include diphenyl phosphate (DPP) and $Mg(BHT)_2(THF)_2$.

Suitable initiators will be known to those skilled in the art. Non-limiting examples are the compounds from which the initiator groups (i) described hereinabove are derived. So compounds of the structures $HOR^6$, $HSR^6$, $NH_2R^6$ or $HNR^6R^7$ where $R^6$ and $R^7$ are independently hydrogen, hydrocarbyl groups or substituted hydrocarbyl groups, which may be aliphatic, cyclic or polycyclic, aromatic or polyaromatic, are suitable. As above, non-limiting examples can be found for example in "*Phosphazene-catalysed ring-opening polymerisation of ε-caprolactone: influence of solvents and initiators*", Haleema Alamri et al., Polym. Chem. 2014, 5, 5471, Specific examples include mono or difunctional alcohols such as 4-methoxybenzyl alcohol, benzyl alcohol, tertiary-butyl alcohol, linear alkanols such as ethanol and propane diol. Other alcohols and compounds carrying hydroxy groups may equally be used. The initiator may also be a polymer, for example a polymer comprising units (a) only carrying a terminal hydroxy group can be used to initiate the subsequent polymerisation of a second lactone in the production of a co-polymer. This is illustrated in Scheme 3 below.

In the following, general examples of the preparation of polymers useful in the present invention are given. It will be understood that these examples are given only to illustrate the polymers and their preparation.

The ring-opening polymerisation of 4-R-caprolactone, initiated, in this example, by 4-methoxybenzyl alcohol, and catalysed, for example, by DPP or $Mg(BHT)_2(THF)_2$, proceeds as shown in Scheme 1:

Scheme 1

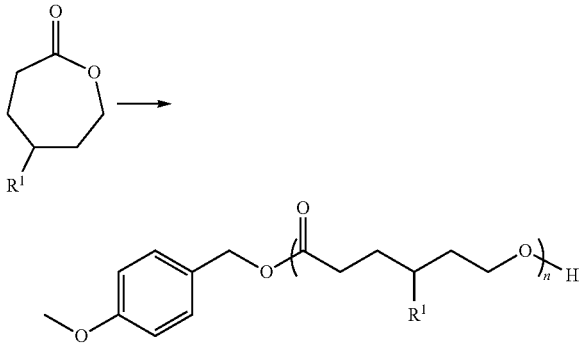

Where n represents the number of repeat units (a) in the polymer. The polymerisation terminating group (t) is hydrogen, and the initiator group (i) is the residue of the 4-methoxybenzyl alcohol initiator. As described above, $R^1$ may be an alkyl group, for example $C_{12}$ linear alkyl.

Allyl functionalized lactones can be used, for example Scheme 2:

Scheme 2

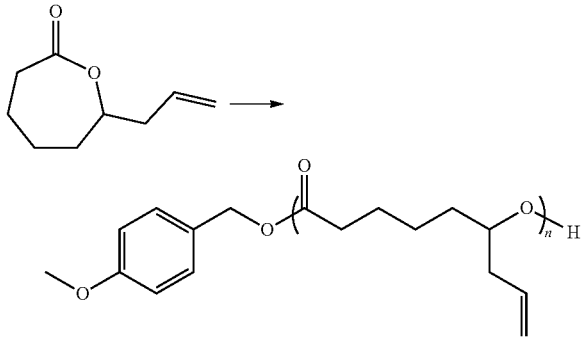

Such polymers may be post-reacted to form polymers where groups R are substituted-hydrocarbyl groups. For example, reaction of the above polymer with an alkyl thiol, $R^4$—SH, employing a 'thiol-ene' click addition reaction, provides:

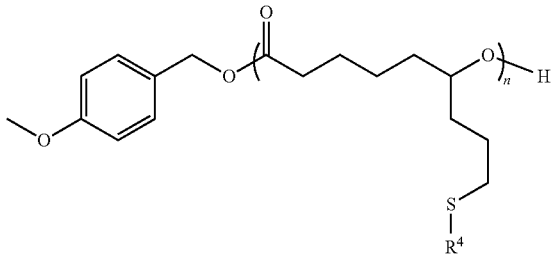

Block co-polymers comprised of units (a) and (b) can be made by the stepwise polymerisation of different lactones. In Scheme 3, the polymer produced in Scheme 1 acts as an initiator for the subsequent polymerisation of a second lactone:

Scheme 3

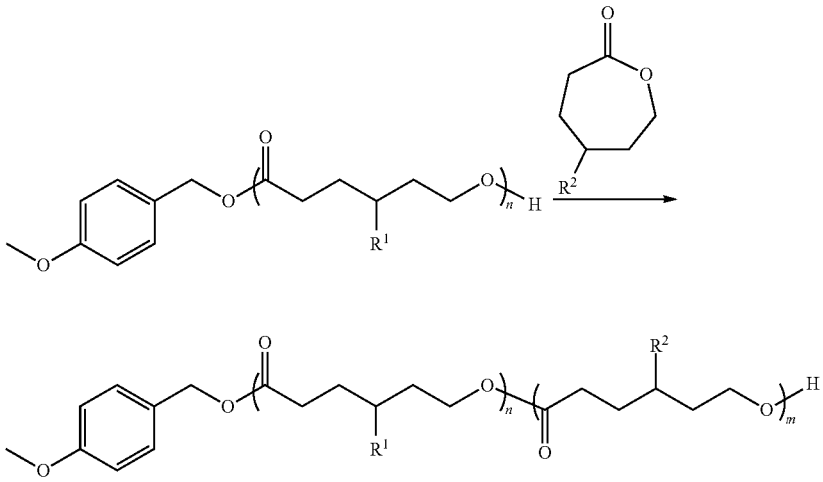

In the polymer produced in Scheme 3, m represents the number of repeat units (b) in the polymer. $R^2$ may be hydrogen, hydrocarbyl or substituted-hydrocarbyl as described hereinabove.

Oil Compositions

Oil compositions of the invention comprise a major amount (at least 50% by mass) of an oil and minor amounts (less than 50% by mass) of performance-enhancing additives, including the polymer. Compositions may also be in the form of an additive concentrate for blending with oil to make a final oil composition.

Preferably the oil compositions of the invention will contain 0.01 to 20 percent by mass, based on the mass of the composition of the polymer, more preferably 0.01 to 10, for example up to 0.5, 1, 2, 3, 4 or 5 percent by mass, based on the mass of the composition. When in the form of an additive concentrate, typically the polymer will be present in an oil in an amount of 30% by mass or more, based on the mass of the composition.

The oil (sometimes referred to as "base stock" or "base oil") is the primary liquid constituent of the oil composition, into which additives and possibly other oils are blended, for example to produce a final lubricant (or lubricant composition). A base oil, which is useful for making additive concentrates as well as for making oil compositions therefrom, may be selected from natural oils (vegetable, animal or mineral) and synthetic lubricating oils and mixtures thereof.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998, which categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

Typically, the base stock has a viscosity preferably of 3-12, more preferably 4-10, most preferably 4.5-8, $mm^2/s$ at 100° C.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Preferably, the oil comprises greater than or equal to 10, more preferably greater than or equal to 20, even more preferably greater than or equal to 25, even more preferably greater than or equal to 30, even more preferably greater than or equal to 40, even more preferably greater than or equal to 45, mass % of a Group II or Group III base stock, based on the total mass of the oil. Even more preferably, the oil comprises greater than 50, preferably greater than or equal to 60, more preferably greater than or equal to 70, even more preferably greater than or equal to 80, even more preferably greater than or equal to 90, mass % of a Group II or Group III base stock, based on the total mass of the oil. Most preferably, the oil consists essentially of a Group II and/or Group III base stock. In some embodiments the oil consists solely of Group II and/or Group III base stock. In the latter case it is acknowledged that additives included in the oil composition may comprise a carrier oil which is not a Group IT or Group III base stock.

Other oils that may be included in the oil composition are detailed as follows:

Natural oils include animal and vegetable oils (e.g. castor and lard oil), liquid petroleum oils and hydro refined, solvent-treated mineral oils of the paraffinic, naphthenic and mixed paraffinic-naphthenic types. Oils derived from coal or shale are also useful base oils.

Synthetic oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic oil comprises the esters of dicarboxylic acids (e.g. phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation, are known to those skilled in the art. Re-refined oils are obtained by processes similar to those used to obtain refined oils applied to refined oils that have been already used in service. Such re-refined oils are also known as reclaimed or reprocessed oils and often are additionally processed by techniques for treating spent additive and oil breakdown products.

Other examples of base oil are gas-to-liquid ("GTL") base oils, i.e. the base oil may be an oil derived from Fischer-Tropsch synthesized hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

The oil may also comprise a Group I, Group IV or Group V base stocks or base oil blends of the aforementioned base stocks.

The lubricating compositions of the present invention preferably comprise at least 60% by weight, for example 70% by weight or more of an oil, based on the weight of the composition.

In a preferred embodiment, the oil composition of the present invention is a lubricating oil composition comprising a major amount (at least 50% by mass) of an oil of lubricating viscosity and minor amounts (less than 50% by mass) of performance-enhancing co-additives, including the polymer. The oil of lubricating viscosity may be any of the oils or mixtures of oils described above. Suitable performance-enhancing co-additives include those customarily used in lubricating oil compositions and will be known to those skilled in the art. The lubricating oil compositions of the present invention are useful in the lubrication of internal combustion engines, both spark and compression-ignited.

Oil compositions of the present invention may alternatively find use as functional fluids such as gear or transmission oils, hydraulic fluids, metal-working fluids and similar.

Performance-Enhancing Co-Additives

The lubricating oil compositions of all aspects of the present invention may further comprise one or more phosphorus-containing compounds; oxidation inhibitors or antioxidants; dispersants; metal detergents; and other co-additives, provided they are different from the polymer defined in relation to the first aspect of the invention. These will be discussed in more detail below.

Suitable phosphorus-containing compounds include dihydrocarbyl dithiophosphate metal salts, which are frequently used as antiwear and antioxidant agents. The metal is preferably zinc, but may be an alkali or alkaline earth metal, or aluminium, lead, tin, molybdenum, manganese, nickel or copper. The zinc salts are most commonly used in lubricating oil in amounts of 0.1 to 10, preferably 0.2 to 2 mass %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$, and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil-soluble salts of dihydrocarbyl dithiophosphoric acids and may be represented by the following formula:

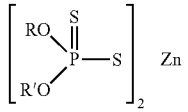

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be 5 or greater. The zinc dihydrocarbyl dithiophosphate (ZDDP) can therefore comprise zinc dialkyl dithiophosphates. Lubricating oil compositions of the present invention suitably may have a phosphorus content of no greater than about 0.08 mass % (800 ppm). Preferably, in the practice of the present invention, ZDDP is used in an amount close or equal to the maximum amount allowed, preferably in an amount that provides a phosphorus content within 100 ppm of the maximum allowable amount of phosphorus. Thus, lubricating oil compositions useful in the practice of the present invention preferably contain ZDDP or other zinc-phosphorus compounds, in an amount introducing from 0.01 to 0.08 mass % of phosphorus, such as from 0.04 to 0.08 mass % of phosphorus, preferably, from 0.05 to 0.08 mass % of phosphorus, based on the total mass of the lubricating oil composition.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. Typical oil-soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen are also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 mass %.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants in this invention are preferably "ashless", as mentioned above, being non-metallic organic materials that form substantially no ash on combustion, in contrast to metal-containing and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025), fluorinated or oxylated. For example, boration may be accomplished by treating an acyl nitrogen-containing dispersant with a boron compound selected from boron oxide, boron halides, boron acids and esters of boron acids.

Preferably, the dispersant, if present, is a succinimide-dispersant derived from a polyisobutene of number average molecular weight in the range of 1000 to 3000, preferably 1500 to 2500, and of moderate functionality. The succinimide is preferably derived from highly reactive polyisobutene.

Another example of dispersant type that may be used is a linked aromatic compound such as described in EP-A-2 090 642.

A detergent is an additive that reduces formation of piston deposits, for example high-temperature varnish and lacquer deposits in engines; it normally has acid-neutralising properties and is capable of keeping finely-divided solids in suspension. Most detergents are based on metal "soaps", that is metal salts of acidic organic compounds.

Detergents generally comprise a polar head with a long hydrophobic tail, the polar head comprising the metal salt of the acidic organic compound. The salts may contain a substantially stoichiometric amount of the metal when they are usually described as normal or neutral salts and would typically have a total base number or TBN at 100% active mass (as may be measured by ASTM D2896) of from 0 to 80. Large amounts of a metal base can be included by reaction of an excess of a metal compound, such as an oxide or hydroxide, with an acidic gas such as carbon dioxide.

The resulting overbased detergent comprises neutralized detergent as an outer layer of a metal base (e.g. carbonate) micelle. Such overbased detergents may have a TBN at 100% active mass of 150 or greater, and typically of from 200 to 500 or more.

Suitably, detergents that may be used include oil-soluble neutral and overbased sulfonates, phenates, sulfurized phenates, thiophosphonates, salicylates and naphthenates and other oil-soluble carboxylates of a metal, particularly alkali metal or alkaline earth metals, e.g. Na, K, Li, Ca and Mg. The most commonly-used metals are Ca and Mg, which may both be present in detergents used in lubricating compositions, and mixtures of Ca and/or Mg with Na. Detergents may be used in various combinations.

Additional additives may be incorporated into the compositions of the invention to enable particular performance requirements to be met. Examples of such additives which may be included in the lubricating oil compositions of the present invention are metal rust inhibitors, viscosity index improvers, dispersant viscosity index improvers, corrosion inhibitors, oxidation inhibitors, additional friction modifiers, anti-foaming agents, anti-wear agents and pour point depressants. Some are discussed in further detail below.

Additional friction modifiers and fuel economy agents that are compatible with the other ingredients of the final oil may also be included. Examples of such materials include glyceryl monoesters of higher fatty acids, for example, glyceryl mono-oleate; esters of long chain polycarboxylic acids with diols, for example, the butane diol ester of a dimerized unsaturated fatty acid; and alkoxylated alkyl-substituted mono-amines, diamines and alkyl ether amines, for example, ethoxylated tallow amine and ethoxylated tallow ether amine.

Other additional friction modifiers comprise oil-soluble organo-molybdenum compounds. Such organo-molybdenum friction modifiers also provide antioxidant and antiwear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formulae: $Mo(R''OCS_2)_4$ and $Mo(R''SCS_2)_4$, wherein R" is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 to 7, Q is selected from the group of neutral electron donating compounds such as water, amines, alcohols, phosphines, and ethers, and z ranges from 0 to 5 and includes non-stoichiometric values. At least 21 carbon atoms should be present among all the ligand organo groups, such as at least 25, at least 30, or at least 35, carbon atoms.

Lubricating oil compositions useful in all aspects of the present invention preferably contain at least 10 ppm, at least 30 ppm, at least 40 ppm and more preferably at least 50 ppm molybdenum. Suitably, lubricating oil compositions useful in all aspects of the present invention contain no more than 1500 ppm, no more than 750 ppm or no more than 500 ppm of molybdenum. Lubricating oil compositions useful in all aspects of the present invention preferably contain from 10 to 1500, such as 30 to 750 or 40 to 500, ppm of molybdenum (measured as atoms of molybdenum).

The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from 5,000 to 250,000, preferably from 15,000 to 200,000, more preferably from 20,000 to 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

Pour point depressants (PPD), otherwise known as lube oil flow improvers (LOFIs) lower the lowest temperature at which the lube flows. Compared to VM, LOFIs generally have a lower number average molecular weight. Like VM, LOFIs can be grafted with grafting materials such as, for example, maleic anhydride, and the grafted material can be reacted with, for example, amines, amides, nitrogen-containing heterocyclic compounds or alcohol, to form multifunctional additives.

When lubricating oil compositions contain one or more of the above-mentioned additives, each additive is typically blended into the base oil in an amount that enables the additive to provide its desired function. Representative effective amounts of such additives, when used in crankcase lubricants, are listed below. All the values listed (with the exception of detergent values since the detergents are used in the form of colloidal dispersions in an oil) are stated as mass percent active ingredient (A.I.).

| ADDITIVE | MASS % (Broad) | MASS % (Preferred) |
|---|---|---|
| Dispersant | 0.1-20 | 0.5-8 |
| Metal Detergents | 0.1-15 | 0.2-9 |
| Corrosion Inhibitor | 0-5 | 0-1.5 |
| Metal dihydrocarbyl dithiophosphate | 0.1-6 | 0.1-4 |
| Antioxidant | 0-5 | 0.01-2.5 |
| Pour Point Depressant | 0-5 | 0-1.5 |
| Antifoaming Agent | 0-5 | 0.001-0.15 |
| Supplemental Antiwear Agents | 1-1.0 | 0-0.5 |
| Additional Friction Modifier | 0-5 | 0-1.5 |
| Viscosity Modifier | 0.01-10 | 0-3 |
| Base stock | Balance | Balance |

Preferably, the Noack volatility of the fully formulated lubricating oil composition (oil of lubricating viscosity plus all additives) is no greater than 30, such as no greater than 22, preferably no greater than 15, mass %. Lubricating oil compositions useful in the practice of the present invention may have an overall sulfated ash content of from 0 to 2.0, such as from 0 to 1.4, preferably from 0 to 1.0, mass %.

It may be desirable, although not essential, to prepare one or more additive concentrates comprising additives (concentrates sometimes being referred to as additive packages) whereby several additives can be added simultaneously to the oil to form the lubricating oil composition.

EXAMPLES

The invention will now be particularly described in the following non-limiting examples.

Synthesis of Polymers

Homopolymers Having Units (a) Only

In a nitrogen-filled glove-box 4-methoxybenzyl alcohol (69.0 mg, 0.40 mmol) as initiator was combined with the appropriate 4-alkyl-ε-caprolactone (24.8 mmol) and diphenyl phosphate (620 mg, 2.48 mmol) or $Mg(BHT)_2(THF)_2$ catalyst (9.6 mg, 0.07 mmol) in dry toluene (25 ml) to form a 1 M solution. This solution was then transferred to an ampoule and stirred at room temperature until polymerisation was complete, ca. 35 to 225 minutes dependent on the caprolactone monomer and catalyst used. Amberlyst® A21 free base was then added to quench the diphenyl phosphate catalysed reaction, whereas trifluoroacetic acid was used to quench the $Mg(BHT)_2(THF)_2$ catalysed reaction. After removing the quenchant by filtration, the polymer was precipitated into cold methanol and then dried.

Polymers (1) and (2) below, were made using 4-dodecyl-ε-caprolactone and 4-octadecyl-ε-caprolactone respectively.

(1)

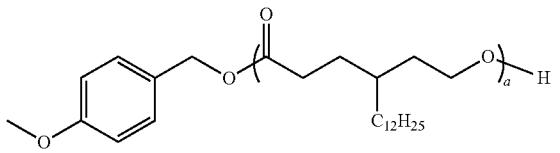

-continued (2)

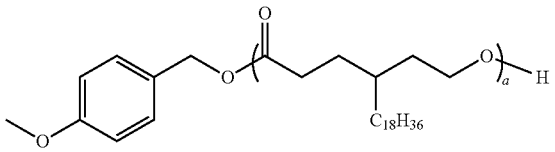

Polymer (1) had a number average molecular weight (Mn) of 11,203 g/mol, a weight average molecular weight (Mw) of 12,215 g/mol, and a dispersity Đ of 1.09. The number of repeat units n was 46.

A polymer similar to polymer (1) also using 4-dodecyl-ε-caprolactone was prepared. This is labelled polymer (1A) and had a number average molecular weight (Mn) of 28,659 g/mol, a weight average molecular weight (Mw) of 30,507 g/mol and a dispersity Đ of 1.06. The number of repeat units n was 102.

A further polymer similar to polymer (1) also using 4-dodecyl-s-caprolactone was prepared. This is labelled polymer (1B) and had a number average molecular weight (Mn) of 51,199 g/mol, a weight average molecular weight (Mw) of 55,969 g/mol and a dispersity Đ of 1.09. The number of repeat units n was 198.

Polymer (2) had a number average molecular weight (Mn) of 5,496 g/mol, a weight average molecular weight (Mw) of 6,194 g/mol and a dispersity Đ of 1.13. The number of repeat units n was 50.

Using a similar method, but using $Mg(BHT)_2(THF)_2$ as a catalyst and a polymerisation temperature of 50° C., Polymer 3 was synthesized from the ε-allyl-ε-caprolactone:

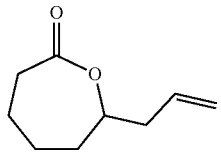

This lactone was prepared by adding $NaHCO_3$ (54.3 mmol) followed by meta-chloroperoxybenzoic acid (43.6 mmol) to a solution of 2-allylcyclohexan-1-one (36.1 mmol) in dry $CH_2Cl_2$ (180 ml) at 0° C. The resulting mixture was allowed to warm to room temperature and stirred for 48 hours. Subsequent purification gave the product as a pale yellow oil in 70% yield.

(3)

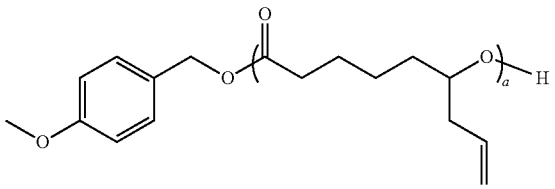

Polymer (3) had a number average molecular weight (Mn) of 12,810 g/mol, a weight average molecular weight (Mw) of 15,934 g/mol and a dispersity Đ of 1.24. The number of repeat units n was 52.

Polymer (4) was prepared by subjecting Polymer (3) to a thiol-ene click reaction. Polymer (3) (59.0 μmol) was dissolved in chloroform (4 ml) and 2-ethylhexanethiol (9.55 mmol) was added followed by a UV initiator (IRGACURE 819) (0.32 mmol). The resulting solution was exposed to UV light (315-400 nm) at room temperature. On completion, the polymer was precipitated into cold methanol and then dried.

(4)

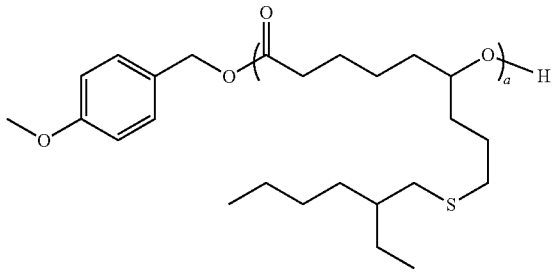

Polymer (4) had a number average molecular weight (Mn) of 16,862 g/mol, a weight average molecular weight (Mw) of 21,860 g/mol and a dispersity Đ of 1.30. The number of repeat units n was 50.

Co-Polymers Having Units (a) and Units (b)

Using standard glovebox techniques, a stock solution was prepared containing polycaprolactone (0.01 mmol) and dry benzene-d6 (500 μL). The polycaprolactone was prepared using the synthesis set out above for polymer (1) but using unsubstituted caprolactone as the monomer. The stock solution (50 μL) was added to 4-dodecyl-f-caprolactone (0.5 mmol) and $Mg(BHT)_2(THF)_2$ (0.04 mmol) in dry benzene-d6 (450 μL) to form a 1 M solution. The solution was then transferred into an ampoule and stirred at room temperature for the allotted time period, suitably between 1 and 4 hours depending on the degree of polymerisation required. The polycaprolactone acted as the initiator for the polymerisation of the 4-dodecyl-ε-caprolactone monomer. The reaction was quenched by the addition of trifluoroacetic acid, which was then removed via precipitation into cold MeOH, cooled using liquid nitrogen. The polymer was dried under vacuum.

(5)

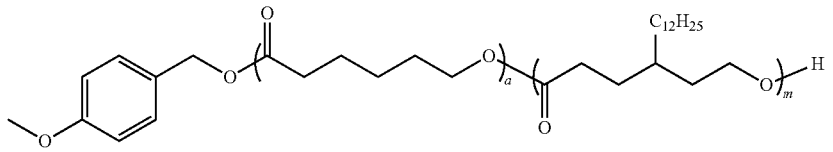

Polymer (5) had a number average molecular weight (Mn) of 23,650 g/mol, a weight average molecular weight (Mw) of 25,980 g/mol and a dispersity Đ of 1.09. The number of repeat units n was 48 and the number of repeat units m was 52.

Tests and Results

Polymers (1), (1A) and (1B) were tested to examine their ability to lower interfacial tension (IFT) and reduce friction.

TABLE 1

| Polymer | DP | Mn (kg/mol) | Mw (kg/mol) | D |
|---|---|---|---|---|
| 1 | 46 | 11.203 | 12.215 | 1.09 |
| 1A | 102 | 28.659 | 30.507 | 1.06 |
| 1B | 198 | 51.199 | 55.969 | 1.09 |

Measurements of IFT were carried out on a Krüss DSA100 using the pendant drop method. All three polymers are able to reduce IFT as shown in table 1 below. This is indicative of surface activity which is desirable for friction reduction.

TABLE 2

| Polymer | IFT (mN/m) |
|---|---|
| None (Group III base oil only) | 37.9 |
| (1) | 26.3 |
| (1A) | 28.2 |
| (1B) | 26.8 |

Friction reduction was measured using a PCS Instruments Mini Traction Machine (MTM) fitted with AISI 52100 steel substrates. Testing was carried out at a sliding speed of 20 mm/s and at either 60'C or 80° C. Traction coefficients are given in Table 3 below. Polymers were added to a base oil in an amount of 0.5% by mass and all were found to reduce friction below that of the base oil alone. At 60° C., the highest molecular weight polymer, polymer (1B), was found to reduce friction more than a commercial friction modifier, glycerol mono-oleate (GMO).

TABLE 3

| polymer | at 60° C. | at 80° C. |
|---|---|---|
| None (base oil only) | 0.085 | 0.095 |
| GMO | 0.071 | 0.077 |
| 1 | 0.075 | 0.084 |
| (1A) | 0.081 | 0.080 |
| (1B) | 0.067 | 0.079 |

The invention claimed is:

1. An oil composition comprising at least 50 percent by mass, based on the mass of the composition, of an oil and 0.01 to 25 percent by mass, based on the mass of the composition, of a block copolymer comprising at least one poly(lactone) segment;

wherein the block copolymer comprises units (a):

$$—C(O)(CHR^1)_pO— \quad (a)$$

wherein p is an integer from 4 to 7;

wherein in one, two or three instances p, $R^1$ is a hydrocarbyl group or substituted hydrocarbyl group having from 6 to 24 carbon atoms, and in all other instances p, $R^1$ is hydrogen; and, units (b):

$$—C(O)(C(H)_xR^2)_qO— \quad (b)$$

wherein units (b) are different from units (a);

wherein q is an integer from 4 to 15; and wherein either (i), in all instances q, $R^2$ is hydrogen, or (ii), wherein in one, two or three instances q, $R^2$ is a hydrocarbyl group or substituted hydrocarbyl group having from 1 to 24 carbon atoms, and in all other instances q, $R^2$ is hydrogen; and wherein either in all instances q, x is 1, or for two contiguous moieties q, x is zero such that units (b) comprise one carbon-carbon double bond, and in all other instances q, x is 1.

2. An oil composition according to claim 1, wherein the block copolymer carries an inorganic or organic polymerisation terminating group (t), and an initiator group (i) being effective to initiate the ring-opening polymerisation of lactones.

3. An oil composition according to claim 1, wherein p is 5.

4. An oil composition according to claim 1, wherein q is an integer from 4 to 10.

5. An oil composition according to claim 1, wherein q is an integer from 4 to 7.

6. An oil composition according to claim 5, wherein p and q are both 5.

7. An oil composition according to claim 1, wherein the total number of units (a) and (b) in the block copolymer is from 10 to 1000 or from 25 to 400.

8. An oil composition according to claim 1, wherein the total number of units (a) and (b) in the block copolymer is from 25 to 400.

9. An oil composition according to claim 1, wherein the ratio of the number of units (a) to the number of units (b) in the block copolymer is from 1:200 to 200:1.

10. An oil composition according to claim 1, wherein the ratio of the number of units (a) to the number of units (b) in the block copolymer is from 1:100 to 100:1.

11. An oil composition according to claim 1, wherein the ratio of the number of units (a) to the number of units (b) in the block copolymer is from 1:50 to 50:1.

12. An oil composition according to claim 1, wherein the ratio of the number of units (a) to the number of units (b) in the block copolymer is from 1:25 to 25:1.

13. An oil composition according to claim 1, wherein the ratio of the number of units (a) to the number of units (b) in the block copolymer is from 1:10 to 10:1.

14. An oil composition according to claim 1, wherein the ratio of the number of units (a) to the number of units (b) in the block copolymer is from 1:5 to 5:1.

15. An oil composition according to claim 1 in the form of a lubricating oil composition formulated for the lubrication of the crankcase of a spark-ignited or a compression-ignited internal combustion engine.

16. A method of lubricating the crankcase of an internal combustion engine comprising operating the engine and lubricating the crankcase with an oil composition according to claim 15.

17. A method for reducing friction between contacting surfaces lubricated by an oil composition comprising providing an oil composition according to claim 1 to the contacting surfaces.

18. An oil composition comprising:

at least 50 percent by mass, based on the mass of the composition, of an oil and 0.01 to 25 percent by mass, based on the mass of the composition, of a block copolymer comprising at least one poly(lactone) segment;

wherein the block copolymer comprises units (a):

$$—C(O)(CHR^1)_pO— \quad (a)$$

wherein p is an integer from 4 to 7;

wherein in one, two or three instances p, $R^1$ is a hydrocarbyl group or substituted hydrocarbyl group having from 4 to 24 carbon atoms, and in all other instances p, $R^1$ is hydrogen; and units (b):

$$—C(O)(C(H)_xR^2)_qO— \quad (b)$$

wherein units (b) are different from units (a);

wherein q is an integer from 4 to 15; and wherein either (i), in all instances q, $R^2$ is hydrogen, or (ii), wherein in one, two or three instances q, $R^2$ is a hydrocarbyl group or substituted hydrocarbyl group having from 1 to 24 carbon atoms, and in all other instances q, $R^2$ is hydrogen; and wherein either in all instances q, x is 1, or for two contiguous moieties q, x is zero such that units (b) comprise one carbon-carbon double bond, and in all other instances q, x is 1.

19. An oil composition according to claim 1, wherein $R^1$ is a hydrocarbyl group or substituted hydrocarbyl group having from 6 to 18 carbon atoms.

20. An oil composition according to claim 1, wherein $R^1$ is a hydrocarbyl group or substituted hydrocarbyl group having from 6 to 20 carbon atoms.

21. An oil composition according to claim 1, wherein $R^1$ is a hydrocarbyl group or substituted hydrocarbyl group having from 8 to 24 carbon atoms.

22. An oil composition according to claim 1, wherein $R^1$ is a hydrocarbyl group or substituted hydrocarbyl group having from 8 to 18 carbon atoms.

23. An oil composition according to claim 1, wherein $R^1$ is a linear $C_8$, $C_{10}$, $C_{12}$, $C_{14}$, $C_{16}$ or $C_{18}$ alkyl group.

* * * * *